United States Patent [19]

Nishimoto et al.

[11] Patent Number: 5,037,447

[45] Date of Patent: Aug. 6, 1991

[54] METHOD FOR PRODUCING LAUNDRY-RESISTANT RECORDING MEDIUM

[75] Inventors: Yoshiyuki Nishimoto, Nishinomiya; Takayasu Hongo, Kobe, both of Japan

[73] Assignee: Kanzaki Paper Manufacturing Company, Limited, Tokyo, Japan

[21] Appl. No.: 301,038

[22] Filed: Jan. 24, 1989

[30] Foreign Application Priority Data

Jan. 30, 1988 [JP] Japan ..... 63-20218

[51] Int. Cl.[5] ..... B41M 3/00; B41M 5/26

[52] U.S. Cl. ..... 8/467; 8/115.67; 8/137; 8/580; 8/919; 106/20; 106/22; 106/23

[58] Field of Search ..... 8/467; 106/22, 23

[56] References Cited

U.S. PATENT DOCUMENTS 4,439,581 3/1984 Irii et al. ..... 524/839
4,624,891 11/1986 Sato et al. ..... 428/321.3

FOREIGN PATENT DOCUMENTS 0244181 4/1986 European Pat. Off. .
3611719 4/1986 Fed. Rep. of Germany .

OTHER PUBLICATIONS

Hackh's Chemical Dictionary, Fourth Edition, (McGraw-Hill), 1972, p. 721: Wax.
Louis F. Fieser and Mary Fieser, Organic Chemistry, 1956, 608-609.

*Primary Examiner*—A. Lionel Clingman
*Attorney, Agent, or Firm*—Larson & Taylor

[57] ABSTRACT

Disclosed is a method for producing a laundry-resistant recording medium comprising a receiving substrate and thermally transferred record images formed on the receiving substrate, the method comprising the steps of forming record images on a receiving substrate of thermal transfer using a thermal transfer recording medium which comprises a layer of a heat-fusible ink comprising a hydroxyl group-containing substance having a softening point of about 50° to about 300° C.; and treating the record images with a polyisocyanate.

15 Claims, 1 Drawing Sheet

METHOD FOR PRODUCING LAUNDRY-RESISTANT RECORDING MEDIUM

The present invention relates to a method for producing a laundry-resistant recording medium with record images formed which are resistant to laundry using an organic solvent or an aqueous detergent and thus free from fading during the laundry.

To improve control of clerical work and laundry operation, the laundry industry has been using tags, labels or like recording media as attached to customers' clothes or the like in laundry. The recording media provide information (names, dates, numbers, bar codes, etc.) recorded on a substrate such as paper or the like for identification of customers' clothes or the like. Tags, labels or like recording media heretofore used include those printed from the same printing plate. The printing method involved in this case is suitable for producing the same printed tags or labels in large quantities, but not for producing a small quantity of various tags or labels intended to show items of customers' information individually different from one another.

To replace said printing method, a thermal transfer recording method has been increasingly carried out using a thermal printer with an ink ribbon to record customers' individually different items of information on a few sheets. However, this thermal transfer recording method can not invariably produce record images which are fully satisfactory in resistance to organic solvents or to aqueous detergents. Said thermal transfer recording method consequently has the disadvantage that when clothes or the like are cleaned which have attached thereto a tag or label having record images formed with an ink ribbon, the record images readily fade, causing difficulty in identification of clothes.

An overcoat of synthetic resin can be formed over the record images produced by a thermal transfer recording method to provide the record images with resistances to organic solvents or to aqueous detergents. Yet, generally such overcoat of synthetic resin can not be reliably adhered to the record images and thus fails to fully achieve the intended effect of overcoating, leaving the record images still unable to resist laundry It is an object of the present invention to provide a method for producing a laundry-resistant recording medium having record images formed with an ink ribbon or like thermal transfer recording medium for use in a thermal transfer recording method by a thermal printer such that the record images on the medium attached to clothes or the like as a tag, a label or the like will not fade in laundry using an organic solvent or an aqueous detergent.

We conducted extensive research to achieve the foregoing object and have accomplished the present invention.

The present invention provides a method for producing a laundry-resistant recording medium comprising a receiving substrate and thermally transferred record images formed on the receiving substrate, the method comprising the steps of forming record images on a receiving substrate by thermal transfer using a thermal transfer recording medium which comprises a layer of a heat-fusible ink comprising a hydroxyl group-containing substance having a softening point of about 50° to about 300° C.; and treating the record images with a polyisocyanate.

According to the present invention, a laundry-resistant recording medium can be obtained which is suitable as a tag or label for cleaning since the record images formed on the medium are not removed in laundry using an organic solvent or an aqueous detergent.

Generally paper sheets and the like can be used in the invention as a receiving substrate constituting a laundry-resistant recording medium, e.g. a tag, label or the like, with record images formed.

Thermal transfer recording media in various forms can be used in the invention and include ink ribbons as preferred ones. The thermal transfer recording medium preferably comprises a support and a heat-fusible ink layer formed on the support.

Supports of the thermal transfer recording media are not specifically limited insofar as they are properly resistant to the heat generated by a thermal printer. Suitable supports are selected from, for example, condenser paper, glassine paper, cellophane film, polyester film, polyacrylate film, polycarbonate film, polyimide film, polyetherimide film, etc. Usable supports are those having a thickness of preferably about 2 to about 25 μm, more preferably about 3 to about 12 μm. When required, a back coat, e.g., a coat of silicone resin, may be formed on the rear side of the support in order to provide an improved running performance and/or a suitable heat resistance.

It is critical in the present invention that the layer of heat-fusible ink to be formed on the support contain a hydroxyl group-containing substance having a softening point of about 50° to about 300° C., preferably about 50° to about 200° C. The hydroxyl group-containing substance is kneaded with a colorant, a heat-fusible binder and the like to obtain a heat-fusible ink composition. Consequently a layer of heat-fusible ink has incorporated therein a hydroxyl group-containing substance having a softening point of about 50° to about 300° C., a colorant and a heat-fusible binder.

Useful colorants are not specifically limited and can be any of those commonly used for thermal transfer recording media and including graphite, carbon black, organic pigments, oil-soluble dyes and the like.

Shown below are examples of the hydroxyl group-containing substance having a softening point of about 50° to about 300° C.:

(1) natural waxes such as carnauba wax, haze wax, bees wax, spermaceti, montan wax, candelilla wax, etc;

(2) synthetic waxes such as polyoxyethylene (tradename "Carbowax" and the like), opal wax and the like; and (3) polyols other than those listed above in (1) and (2), alcohol-modified waxes and the like; etc.

Natural waxes generally comprise free fatty acid, free alcohol, their esters, hydrocarbons and the like and contain the hydroxyl group of the free alcohol. The free alcohol content is, for example, about 10 to about 12% by weight in the case of carnauba wax or about 10 to about 15% by weight in the case of candelilla wax Of synthetic waxes, polyoxyethylene has hydroxl groups, and opal wax is otherwise named hardened castor oil and has hydroxyl groups. Examples of polyols other than natural waxes and synthetic waxes are partially saponified vinyl acetate polymer, partially saponified ethylene-vinyl acetate copolymer and the like, polycaprolactone polyols (among which usually those having a hydroxyl value of about 30 to about 240 are preferred); polycarbonate polyols (among which usually those having a hydroxyl value of about 60 to about 200 are preferred); etc. In forming the heat-fusible ink composition by kneading, these substances are usable singly or at least two of them can be used in mixture.

Described below are the reasons for limiting the softening point of the hydroxyl group-containing substance to about 50° to about 300° C., preferably about 50° to about 200° C., in the present invention. The heat-fusible ink of the invention, which is in a solid form at room temperature, is softened and fused when heated by the recording head of a thermal printer, whereupon a portion of the ink is transferred to a receiving substrate for use as a tag or label to form record images thereon. Consequently the use of the hydroxyl group-containing substance with a softening point of higher than 300° C. results in reduced amount of ink transferred to the receiving substrate even in heating by contact with the thermal head, lowering the degree of adequacy for recording. The use of the substance with a softening point of lower than 50° C. causes blocking in a roll of thermal transfer recording medium during storage due to adhesion of a heat-fusible ink layer to a rear side of the thermal transfer recording medium, stains the unprinted area of receiving substrate during printing or induces the transfer of ink by the remaining heat of de-energized thermal head to bring about undesirable soiling, failing to provide precisely defined images.

Useful heat-fusible binder component to be incorporated into the heat-fusible ink composition is not specifically limited and can be any of those commonly used in the field of thermal transfer recording media and including polyvinyl acetate, (α-methyl)styrene resins, vinyl toluene resins, acrylate resins, ethylene-vinyl acetate copolymers, ethyelene-acrylate copolymers, vinyl chloride-vinyl acetate copolymers, rosin resins, terpene resins, alicyclic resins, etc. These heat-fusible binder resins preferably have a softening point of about 50° to 300° C., more preferably about 50° to 200° C.

There is no specific limitation on the amounts of the colorant, hydroxyl group-containing substance of about 50° to about 300° C. in softening point and heat-fusible binder to be incorporated in the heat-fusible ink layer. While the amounts thereof can be varied over a wide range, it is preferred to use about 5 to about 40 parts by weight of the colorant and about 10 to about 40 parts by weight of the heat-fusible binder, each per 100 parts by weight of the hydroxyl group-containing substance having the specific softening point.

When required, the heat-fusible ink layer according to the invention may contain a heat-meltable substance having a softening point of about 50 to about 300° C. and free of hydroxyl group. Preferred hydroxyl group-free heat-meltable substances are polyethylene wax, paraffin wax, etc. Such hydroxyl group-free heat-meltable substance can produce the effect of controlling the melt viscosity of the ink, thereby improving the distinctness of the record image, and is used if so desired. When used, the hydroxyl group-free heat-meltable substance is used in an amount of less than about 50 parts by weight, particularly about 3 to about 50 parts by weight, preferably less than about 30 parts by weight, per 100 parts by weight of the hydroxyl group-containing substance of about 50° to about 300° C. in softening point.

When required, the ink composition for forming the heat-fusible ink layer may further contain various auxiliary agents such as anionic, nonionic, cationic or amphoteric surfactants, dispersants, viscosity modifiers, flexibilizers, plasticizers, brighteners, antioxidants, antistatic agents, crosslinking agents, perfume, etc. A filler can be added insofar as the addition does not impair the contemplated effect of the invention. Examples of useful fillers are calcium carbonate, talc, kaolin, natural or synthetic silicic acids, titanium oxide, aluminum hydroxide, zinc oxide, plastic pigments, etc.

The thermal transfer recording medium for use in the present invention can be prepared by applying the ink composition containing the foregoing components to the support. The amount of the ink composition to be applied is suitably adjusted according to a particular purpose of the thermal transfer recording medium, and is generally in the range of about 2 to about 6 g/m$^2$.

The coating operation is carried out by a conventional method such as hotmelt coating method. According to the hotmelt coating method, a coating composition in a molten state is applied by, for example, a gravure coater, reverse roll coater, die coater, bar coater or the like. If desired, the coating surface is made uniform by smoothing treatment, post-heating treatment or the like, whereby the desired thermal transfer recording medium can be obtained.

The present invention is characterized by treating with a polyisocyanate the record images formed by thermal transfer recording on a receiving substrate for use as a tag, a label or the like. Thermal transfer recording can be performed in a conventional manner with use of a conventional thermal printer. The treatment of record images with a polyisocyanate is carried out by causing the polyisocyanate to contact with and/or permeate into the ink constituting the record images which have been thermally transferred to the receiving substrate so that the polyisocyanate can crosslink the hydroxyl group-containing compounds present in the ink while also acting to form crosslink between the hydroxyl group-containing compound in the ink and cellulose of the paper used as the receiving substrate, rendering the record images insoluble in an organic solvent or aqueous detergent used for laundry.

For effecting the treatment of the record images, the polyisocyanate is used either as it is, i.e. in a liquid state, or the polyisocyanate may be used as dissolved in a solvent. Useful solvents are not specifically limited and can be any of known organic solvents which are capable of dissolving the polyisocyanate and which have a boiling point of about 50° to about 170° C. under atmospheric pressure. Typical examples of such solvents are methyl ethyl ketone, ethyl acetate, toluene, xylene, butyl acetate, etc. The concentration of the polyisocyanate solution is not specifically limited and is in the range of about 1 to about 30% by weight.

The treatment with the polyisocyanate can be effected by passing the receiving substrate having the record images formed thereon through the polyisocyanate in a liquid state or as dissolved in a solvent to react the hydroxyl groups present in the ink consituting the images with the polyisocyanate, or by applying or spraying the polyisocyanate in a liquid state or in a dissolved state over the record images formed on the receiving substrate.

Various polyisocyanates are useful which, when caused to act on the record images, can react with the hydroxyl group in the paper serving as the receiving substrate and with the hydroxyl group-containing susbtance contained in the ink constituting the record images to give a crosslinking reaction products insoluble in an organic solvent or aqueous detergent for laundry. Preferred polyisocyanates are those capable of producing such crosslinking reaction product at room temperature. Examples of useful polyisocyanates are (1) m-phenylenediisocyanate, p-phenylenediisocyanate, 2,6-tolylene diisocyanate, 2,4-tolylene diisocyanate, naphthalene-1,4-diisocyanate, diphenylmethane-4,4'-diisocyanate, 3,3'-dimethoxy-4,4'-biphenyldiisocyanate, 3,3'-dimethyldiphenylmethane-4,4'-diisocyanate, xylylene-1,4-diisocyanate, 4,4'-diphenylpropanediisocyanate, trimethylenediisocyanate, hexamethylenediisocyanate, propylene-1,2-diisocyanate, butylene-1,2-diisocyanate, ethylidyneisocyanate, cyclohexylene-1,2-diisocyanate, cyclohexylene-1,4-diisocyanate, isophoronediisocyanate, p-phenylenediisothiocyanate, xylylene-1,4-diisocyanate, ethylidynediisothiocyanate, dimethylsilyldiisocyanate, vinylmethylsilylisocyanate, 4-isocyanatomethyl-1,8-octamethylenediisocyanate, lysinediisocyanate, bis(isocyanatomethyl)cyclohexane, dicyclohexylmethanediisocyanate, trimethylhexamethylenediisocyanate and like diisocyanates or diisothiocyanates; 4,4',4''-triphenylmethanetriisocyanate, toluene-2,4,6-triisocyanate, tris(isocyanatophenyl)thiophosphate, methylsilyltriisocyanate, vinylsilyltriisocyanate, phenylsilyltriisocyanate, octadecylsilyltriisocyanate, methoxysilanetriisocyanate, butoxysilanetriisocyanate, octylsilanetriisocyanate, 2,6-diisocyanatocaproic acid-$\beta$-isocyanatoethyl ester, 2,6-diisocyanatocaproic acid-$\gamma$-diisocyanatopropyl ester, 2,6-diisocyanatocaproic acid-2-methyl-$\beta$-isocyanate ester, trimer of hexamethylenediisocyanate and like triisocyanates; polymethylenepolyphenylpolyisocyanate, 4,4'-dimethyldiphenylmethane-2,2',5,5'-tetraisocyanate, tetraisocyanatesilane, biuret type-polyisocyanate containing the residue derived from hexamethylenediisocyanate and isophoronediisocyanate, and like polyvalent isocyanates, etc.;

(2) urethane-modified, isocyanurate-modified or carbodiimide-modified products of the above-exemplified polyisocyanates, blocked isocyanates of the above-exemplified polyisocyanates and like isocyanate derivatives; etc.

The laundry-resistant recording medium obtained by the method of the invention, namely by treating with polyisocyanate the recording medium comprising a support and record images formed on the support, are resistant to organic solvents and aqueous detergents commonly used for laundry of clothes and the like. Examples of the organic solvent for use herein are tetrachloroethylene, trichloroethylene, etc. Examples of the aqueous detergent for use herein are synthetic detergents, soaps, etc. which contain as a component sodium alkylbenzenesulfonate, sodium alkylethersulfate, sodium $\alpha$-olefinsulfonate, fatty acid alkanolamide, alkylamine oxide, sodium tripolyphosphate, sodium metasilicate or the like.

A preferred embodiment of the method according to the invention will be described below with reference to the accompanying drawings to which, however, the invention is not limited.

Figure 1:
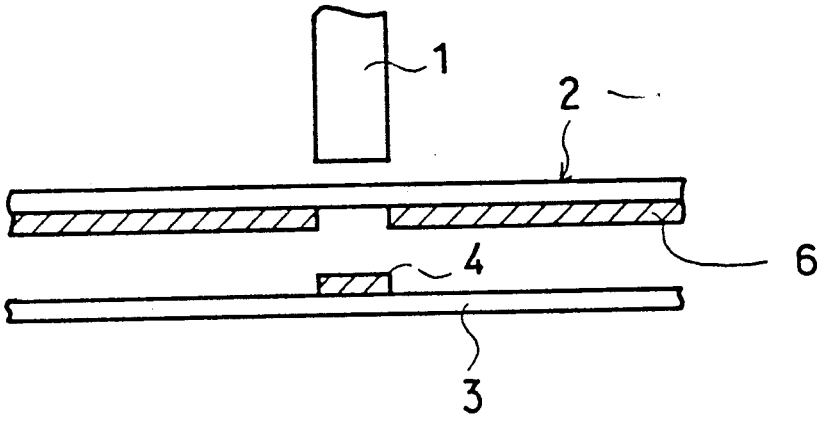
FIG. 1 is a sectional view schematically showing thermal transfer recording being performed over a receiving substrate by a thermal printer using a thermal transfer recording medium in the form of an ink ribbon.
Figure 2:
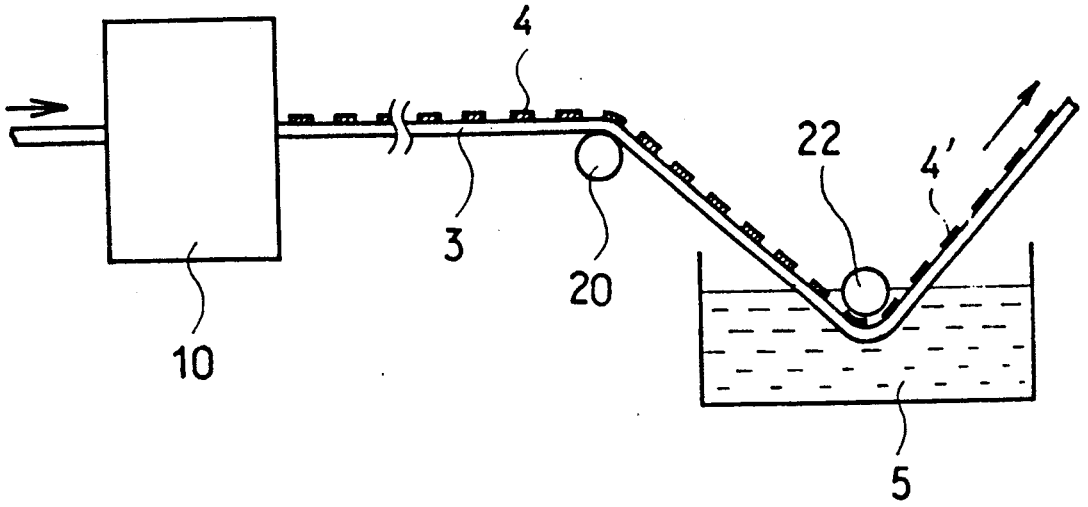
FIG. 2 is a sectional view schematically showing the recording medium being passed through a polyisocyanate solution to react the record images formed by the recording procedure of FIG. 1 with the polyisocyanate.

As shown in FIG. 1, a thermal transfer recording medium 2 is heated from the rear side thereof by a thermal head 1 of a thermal printer 10 illustrated in FIG. 2, whereupon a portion of an ink layer 6 is transferred to a receiving substrate 3 made of paper, giving record images 4.

The receiving substrate 3 having the record images 4 thus formed thereon is guided by guide rollers 20, 22 and moved in the direction of arrows to pass through a polyisocyanate 5 in a dissolved state or in a liquid state at a speed effective for crosslinking the hydroxyl group-containing compounds in the ink and forming crosslink between the hydroxyl group-containing compound in the ink and cellulos of the paper used as the receiving substrate 3. Then, the receiving substrate 3 is dried. In this way, the polyisocyanate is reacted with the hydroxyl group-containing substance in the ink constituting the record images 4 and the receiving substrate 3 (paper sheet) to form a crosslinking reaction product insoluble in the organic solvent or aqueous detergent for use in laundering with the result that there is provided record images 4' which are insoluble in the organic solvent or aqueous detergent, giving a laundry-resistant recording medium.

The treatment of record images 4 with the polyisocyanate 5 is usually finished in a relatively short time and the crosslinking reaction is usually completed in a moment. When the polyisocyanate solution is air-dried, the crosslinking reaction may be accelerated by raising the temperature of hot air to from about 40 to 150° C.

The laundry-resistant recording medium is then cut for use as tags, labels or the like.

Given below are Examples illustrative of the invention and Comparative Example. The invention is not limited to these Examples. In the Examples and the Comparative Examples, the percentages and parts are all by weight.

EXAMPLE 1

A 10-part quantity of carbon black, 25 parts of carnauba wax (with a softening point of 83° C. and a free alcohol content of 10 to 12% by weight), 50 parts of alcohol-modified wax (hydroxyl value of 80 and softening point of 78° C.) and 15 parts of ethylene-vinyl acetate copolymer having a softening point of 80° C. were kneaded and the mixture was coated on a 6 $\mu$m-thick film of polyethyleneterephthalate, giving a thermal transfer ink ribbon. For use as a label for laundry, intended record images were formed on a paper sheet weighing 130 g/m$^2$ by a thermal printer (tradename "KANZAKI THERMAL PRINTER K-8216" as manufactured by KS Systems) with said ink ribbon. The recorded label was passed through a solution of polymethylenepolyphenylpoly-isocyanate in methyl ethyl ketone having a concentration of 20% by weight at 20° C. such that each of the record images was immersed in said solution of polyisocyanate for 4 seconds. Then the treated label was air-dried at 20° C. In this way, label specimens were prepared.

Some of the label specimens were attached to clothes, which were subjected to dry-cleaning using tetrachloroethylene as the organic solvent. The remaining label specimens were attached to clothes, which were then subjected to wet-cleaning using as an aqueous detergent a mixture of sodium alkyl ether sulfate, sodium $\alpha$-olefinsulfonate, fatty acid alkanolamide and alkylamine oxide. In either case, no elimination of record images was found.

EXAMPLE 2

A 10-part quantity of carbon black, 60 parts of carnauba wax (with a softening point of 83° C. and a free alcohol content of 10 to 12% by weight), 15 parts of polyethylene wax having a softening point of 72° C. and 15 parts of ethylene-vinyl acetate copolymer having a softening point of 80° C. were kneaded and the mixture was coated on a 6 μm-thick film of polyethyleneterephthalate, giving a thermal transfer ink ribbon. For use as a label for laundry, intended record images were formed on a paper sheet weighing 130 g/m$^2$ by the thermal printer of the type used in Example 1 with the ink ribbon. The recorded label was passed through a solution of a prepolymer of tolylenediisocyanate in ethyl acetate having a concentration of 20% by weight at 20° C. such that each of the record images was immersed in said solution for 4 seconds. Then the treated label was air-dried at 20° C. In this way, a number of label specimens were prepared.

Some of the label specimens were attached to clothes, which were then subjected to dry-cleaning using tetrachloroethylene as the organic solvent in the same manner as in Example 1. The remaining label specimens were tagged to clothes, which were then subjected to wet-cleaning using the aqueous detergent in the same manner as in Example 1. In either case, no elimination of record images was found.

COMPARATIVE EXAMPLE 1

The same procedure as done in Example 1 was repeated except that the record images formed by the thermal printer was not treated with the polymethylenepolyphenylpolyisocyanate.

The label specimens were each attached to clothes, which were then subjected to laundry using tetrachloroethylene as the organic solvent or to laundry using the aqueous detergent, respectively in the same manner as in Example 1. It was found that the record images faded in either case.

We claim:

1. A method for producing a laundry-resistant tag or label comprising a substrate and a thermally transferred image formed on the substrate, the method comprising the steps of forming an image on said substrate by thermal transfer using a thermal transfer medium which comprises a layer of heat-fusible ink comprising a cross-linkable, hydroxyl group containing substance having a softening point of about 50° to about 300° C., said substance being selected from the group consisting of hydroxyl group-containing natural waxes, hydroxyl group-containing synthetic waxes, partially saponified vinyl acetate polymer, partially saponified ethylene-vinyl acetate copolymer, polycaprolactone polyol, and polycarbonate polyol, said ink further comprising at least one colorant selected from the group consisting of graphite, carbon black, organic pigment and oil-soluble dye; and subsequently contacting said image with a polyisocyanate capable of entering into a cross-linking reaction with the hydroxyl groups of said cross-linkable hydroxyl group-containing substance to produce a laundry-resistant tag or label.

2. A method according to claim 1 wherein the thermal transfer recording medium comprises a support and a layer of heat-fusible ink on the support.

3. A method according to claim 1 wherein the heat-fusible ink further comprises a heat-fusible binder.

4. A method according to claim 3 wherein the hydroxyl group-containing substance has a softening point of about 50° to about 200° C.

5. A method according to claim 3 wherein the heat-fusible ink further contains a hydroxyl group-free heat-meltable polyethylene wax or paraffin wax for controlling the melt viscosity of the ink, said heat-meltable wax having a softening point of about 50° to about 300° C.

6. A method according to claim 3 wherein the hydroxy group-containing substance comprises at least one member selected from the group consisting of hydroxyl group-containing natural waxes, hydroxyl group-containing synthetic waxes, partially saponified vinyl acetate polymer, partially saponified ethylene-vinyl acetate copolymer, polycaprolactone polyol, and polycarbonate polyol, each having a softening point of about 50° to about 300° C.

7. A method according to claim 1 wherein the hydroxyl group-containing substance is selected from the group consisting of carnauba wax, haze wax, bees wax, spermaceti, montan wax, candelilla wax, polyoxyethylene, and opal wax, each having a softening point of about 50° to about 300° C.

8. A method according to claim 7 wherein the hydroxyl group-consisting substance has a softening point of about 50° to about 200° C.

9. A method according to claim 3 wherein the colorant is at least one member selected from the group consisting of graphite, carbon black, organic pigment and oil-soluble dye.

10. A method according to claim 3 wherein the heat-fusible binder is at least one member selected from the group consisting of polyvinyl acetate, styrene resins, vinyl toluene resins, acrylate resins, ethylene-vinyl acetate copolymers, ethyelene-acrylate copolymers, vinyl chloride-vinyl acetate copolymers, rosin resins, and terpene resins.

11. A emthod according to claim 3 wherein the heat-fusible ink comprises about 5 to about 40 parts by weight of said colorant and about 10 to about 40 parts by weight of said heat-fusible binder, each per 100 parts by weight of the hydroxyl group-containing substance.

12. A method according to claim 1 wherein said substrate comprises paper.

13. A method according to claim 1 wherein said image is treated by passing the substrate having the image thereon through a polyisocyanate dissolved in a solvent or in a liquid state or by applying or spraying the polyisocyanate dissolved in a solvent or in a liquid state over the record image formed on the substrate.

14. A method accoding to claim 1 wherein said substrate comprises cellulose-containing paper and wherein the polyisocyanate reacts to form crosslinks between the hydroxyl groups of said hydroxyl group-containing substance in the ink and with the cellulose of the paper used as the receiving substrate, rendering the record images insoluble in an organic solvent or aqueous detergent used for laundry.

15. A method according to claim 1 wherein said polyisocyanate is in the liquid state.

* * * * *